US009093795B2

(12) United States Patent
Ashibu

(10) Patent No.: US 9,093,795 B2
(45) Date of Patent: Jul. 28, 2015

(54) FLEXIBLE PRINTED CIRCUIT CONNECTOR

(71) Applicant: JAPAN AVIATION ELECTRONICS INDUSTRY, LIMITED, Shibuya-ku, Tokyo (JP)

(72) Inventor: Kenta Ashibu, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 29 days.

(21) Appl. No.: 13/913,075

(22) Filed: Jun. 7, 2013

(65) Prior Publication Data

US 2013/0330973 A1 Dec. 12, 2013

(30) Foreign Application Priority Data

Jun. 11, 2012 (JP) ..... 2012-131688

(51) Int. Cl.

| | |
|---|---|
| ***H01R 13/15*** | (2006.01) |
| ***H01R 12/70*** | (2011.01) |
| ***H01R 12/79*** | (2011.01) |
| ***H01R 12/88*** | (2011.01) |

(52) U.S. Cl.

CPC ..... *H01R 12/7011* (2013.01); *H01R 12/79* (2013.01); *H01R 12/88* (2013.01)

(58) Field of Classification Search

CPC ..... H01R 12/79; H01R 12/592; H01R 23/684
USPC ..... 439/260, 492–495, 499
See application file for complete search history.

(56) References Cited

U.S. PATENT DOCUMENTS

| | | | | |
|---|---|---|---|---|
| 5,904,589 | A * | 5/1999 | Asakawa | 439/495 |
| 6,726,497 | B2 * | 4/2004 | Nogawa et al. | 439/260 |
| 7,255,584 | B2 * | 8/2007 | Takashita | 439/260 |
| 7,300,304 | B1 * | 11/2007 | Takashita | 439/495 |
| 7,445,495 | B2 * | 11/2008 | Takashita | 439/495 |
| 7,467,962 | B2 * | 12/2008 | Sunaga | 439/260 |
| 7,601,017 | B2 * | 10/2009 | Wang et al. | 439/260 |
| 7,766,694 | B2 * | 8/2010 | Tanaka et al. | 439/495 |
| 7,828,571 | B2 * | 11/2010 | Satoh et al. | 439/260 |

(Continued)

FOREIGN PATENT DOCUMENTS

| | | |
|---|---|---|
| JP | 2007-122894 A | 5/2007 |
| JP | 2009-064577 A | 3/2009 |

(Continued)

OTHER PUBLICATIONS

Japanese Office Action dated Jul. 4, 2013 (and English translation thereof) in counterpart Japanese Application No. 2012-131688.

(Continued)

*Primary Examiner* — Thanh Tam Le
(74) *Attorney, Agent, or Firm* — Holtz, Holtz, Goodman & Chick PC

(57) ABSTRACT

A connector allows a sheet-like or plate-like object to be inserted thereinto. The object is, for example, an FPC or an FFC. The connector comprises a signal contact and a holding member. The signal contact and the holding member have the same shape as each other. Each of the signal contact and the holding member has a contact portion and a lock portion. Each of the contact portions has a non-angular shape which is suitable for a contact with the object. Each of the lock portions has an angular shape which is suitable for holding the object.

10 Claims, 9 Drawing Sheets

(56) References Cited

U.S. PATENT DOCUMENTS

| | | | | |
|---|---|---|---|---|
| 7,845,962 | B2 * | 12/2010 | Chung et al. | 439/260 |
| 8,052,446 | B1 * | 11/2011 | Chen et al. | 439/260 |
| 8,075,328 | B2 * | 12/2011 | Ashibu | 439/260 |
| 8,079,861 | B2 * | 12/2011 | Suzuki et al. | 439/260 |

FOREIGN PATENT DOCUMENTS

| | | | |
|---|---|---|---|
| JP | 2011-222272 | A | 11/2011 |
| JP | 2011-222273 | A | 11/2011 |
| JP | 2011-253630 | A | 12/2011 |

OTHER PUBLICATIONS

Japanese Office Action dated Jul. 10, 2014 in counterpart Japanese Application No. 2013-175484.

Korean Office Action dated Jun. 2, 2014 in counterpart Korean Application No. 10-2013-0060046.

Chinese Office Action (and English translation thereof) dated Apr. 27, 2015, issued in counterpart Chinese Application No. 201310213758.9.

* cited by examiner

PRIOR ART

FLEXIBLE PRINTED CIRCUIT CONNECTOR

CROSS REFERENCE TO RELATED APPLICATIONS

An applicant claims priority under 35 U.S.C. §119 of Japanese Patent Application No. JP2012-131688 filed Jun. 11, 2012.

BACKGROUND OF THE INVENTION

This invention relates to a connector configured to be connected to a plate-like or sheet-like object such as a Flexible Printed Circuit (FPC) or a Flexible Flat Cable (FFC).

For example, this type of connector is disclosed in JP-A 2011-253630 (Patent Document 1) or JP-A 2011-222273 (Patent Document 2), contents of which are incorporated herein by reference.

The connector of Patent Document 1 or Patent Document 2 has a structure for temporarily holding a plate-like or sheet-like object when an actuator of the connector is in an open state.

As shown in FIG. 14, the connector of Patent Document 1 comprises an actuator 900, a second terminal (signal contact) 910 and a metal member (holding member) 920. The metal member 920 has almost the same shape as the second terminal 910. In detail, the second terminal 910 has a pressing protrusion 912 while the metal member 920 has a lock portion 922 corresponding to the pressing protrusion 912. The lock portion 922 is larger than the pressing protrusion 912. The connector holds a flat conductive-object (object) 930 by the lock portion 922.

As shown in FIG. 15, the connector of Patent Document 2 comprises a contact (signal contact) 950 and a holding terminal (holding member) 960. The holding terminal 960 has almost the same shape as the contact 950. In detail, the contact 950 has two contact portions 952 formed at front ends thereof while the holding terminal 960 has two engaging protrusions 962 formed at front ends thereof. A distance between the two engaging protrusions 962 is smaller than a thickness of a cable (object). The connector holds the cable by the engaging protrusions 962 of the holding terminal 960.

As described above, the connector of Patent Document 1 or Patent Document 2 has not only the signal contact but also the holding member for holding the object. Thus, as compared with a connector which holds the object only by using a contact, the number of types of components is increased.

SUMMARY OF THE INVENTION

It is therefore an object of the present invention to provide a connector having a holding function other than that of a contact without increasing the number of types of components.

One aspect of the present invention provides a connector configured to allow a sheet-like or plate-like object to be inserted rearward from a front end in a front-rear direction. The object has a locked portion. The connector comprises a housing, an actuator and a plurality of members including a signal contact and a holding member. The actuator is supported by the housing so as to be pivotable between an open state and a close state. The signal contact and the holding member are held by the housing so as to be arranged in a pitch direction perpendicular to the front-rear direction. The signal contact has a shape same as the holding member. Each of the signal contact and the holding member has a contact portion and a lock portion located rearward of the contact portion in the front-rear direction. Each of the contact portions has a non-angular shape. Each of the lock portions has an angular shape. The contact portion of the signal contact is pressed against the object under a predetermined state where the object is inserted in the connector and where the actuator is in the close state. The lock portion of the signal contact is apart from the object in a vertical direction perpendicular to both the front-rear direction and the pitch direction under the predetermined state. The lock portion of the holding member is located at a regulation position under the predetermined state. The regulation position is in front of the locked portion of the object. The lock portion of the holding member regulates a forward movement of the object when located at the regulation position.

An appreciation of the objectives of the present invention and a more complete understanding of its structure may be had by studying the following description of the preferred embodiment and by referring to the accompanying drawings.

Figure 1:
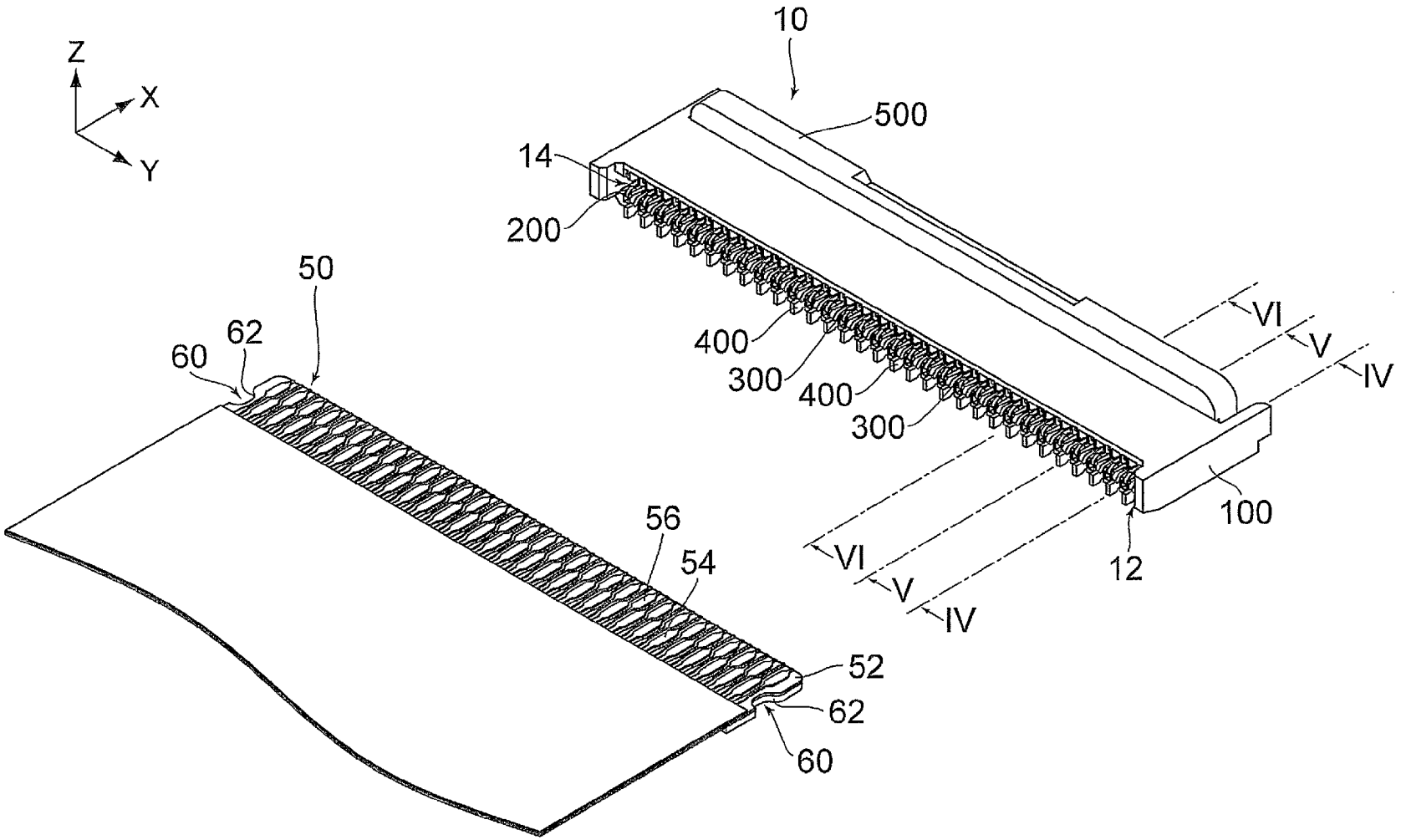
FIG. 1 is a perspective view showing a connector and an FPC (object) according to an embodiment of the present invention, wherein the FPC is not yet inserted in the connector.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
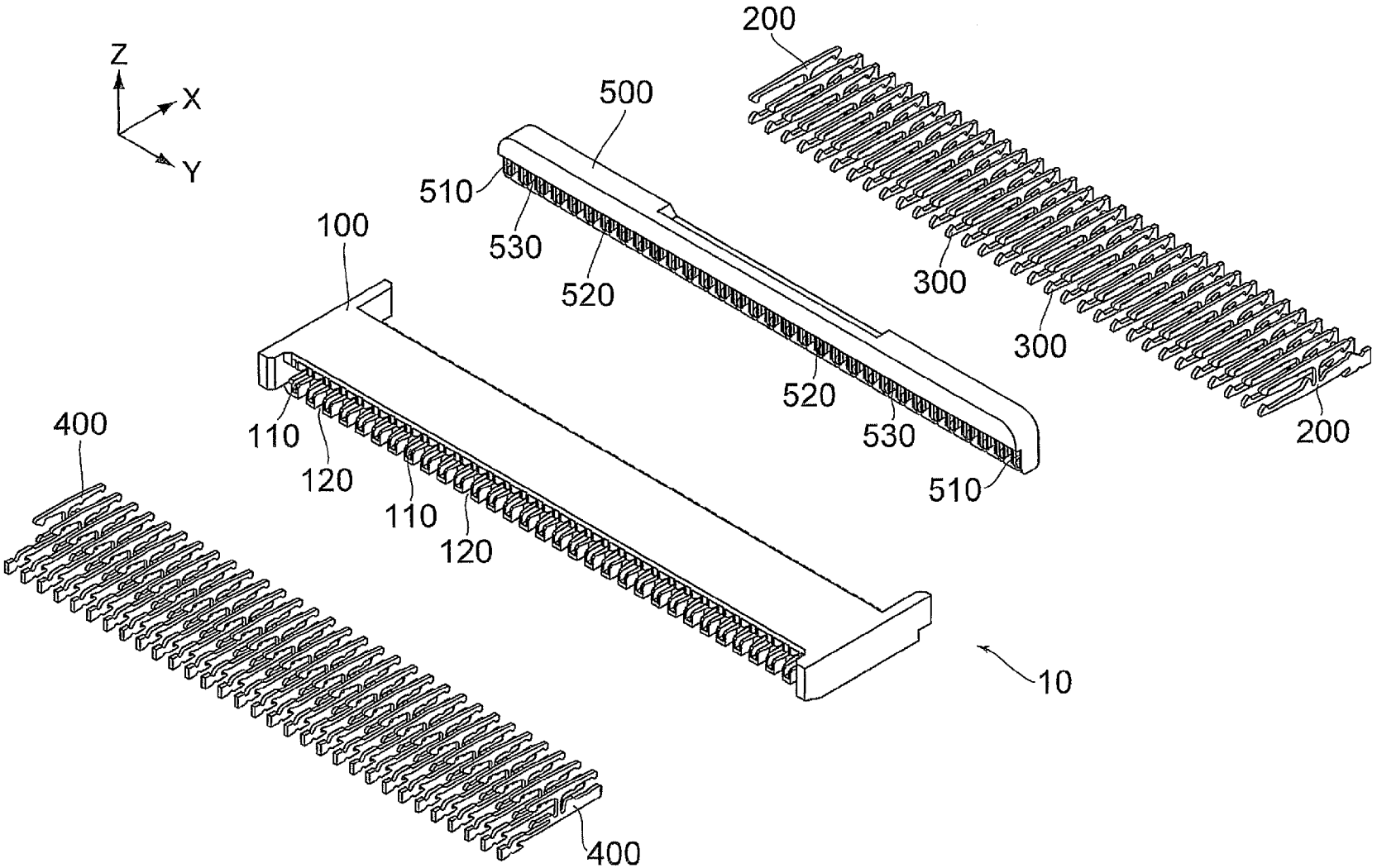
FIG. 2 is an exploded, perspective view showing the connector of FIG. 1.
Figure 3:
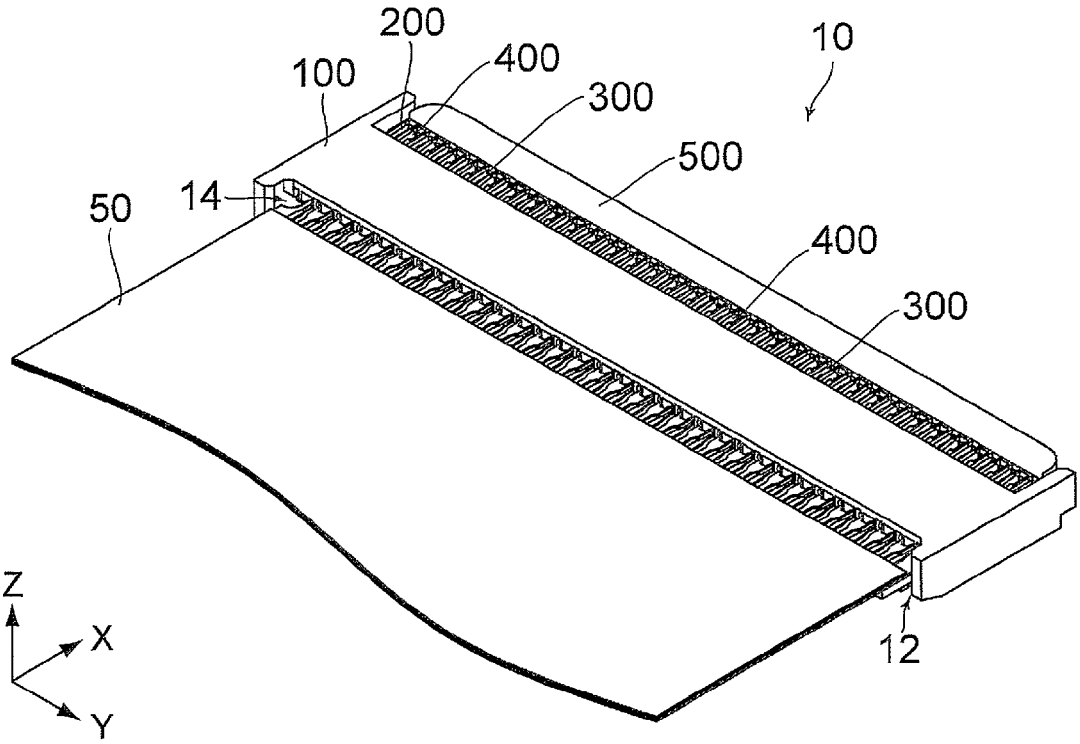
FIG. 3 is another perspective view showing the connector and the FPC of FIG. 1, wherein the FPC is inserted in the connector.

Referring to FIGS. 1 to 3, a connector 10 according to an embodiment of the present invention has a receive portion 14. The receive portion 14 is configured to receive an FPC (object) 50 inserted from a front end 12 in the X-direction (front-rear direction) along the positive X-direction (i.e. rearward). As best shown in FIG. 1, the FPC 50 is formed with a plurality of terminals 54 and 56, and two recesses 60. The terminals 54 and 56 are formed on an upper surface in the vicinity of an end portion 52 of the FPC 50. The recesses 60 are recessed inward in the Y-direction (pitch direction) from opposite sides in the Y-direction, respectively. Each of the recesses 60 has an edge close to the end portion 52. This edge of the recess 60 functions as a locked portion 62.

As best shown in FIG. 2, the connector 10 comprises a housing 100 made of an insulating material, two holding members 200 each made of a conductive material, a plurality of first signal contacts (signal contacts) 300 each made of a conductive material, a plurality of second signal contacts 400 each made of a conductive material and an actuator 500 made of an insulating material.

As shown in FIGS. 2 and 4 to 6, the housing 100 has a plurality of first holding portions 110 and a plurality of second holding portions 120. The first holding portions 110 and the second holding portions 120 are arranged alternately in the Y-direction. Thus, the first holding portions 110 and the second holding portions 120 constitute a holding row of a plurality of holding portions. Two of the first holding portions 110 are located at respective outermost positions of the holding row in the Y-direction. In other words, the aforementioned two first holding portions 110 are the outermost holding portions of the holding row. Each of the first holding portions 110 is provided with a first press-fitted portion 112. Each of the second holding portions 120 is provided with a second press-fitted portion 122. The first holding portions 110, those are the outermost holding portions, hold the holding members 200, respectively, while the other first holding portions 110 hold the first signal contact 300, respectively. The second holding portions 120 hold the second signal contact 400, respectively.

Figure 4:
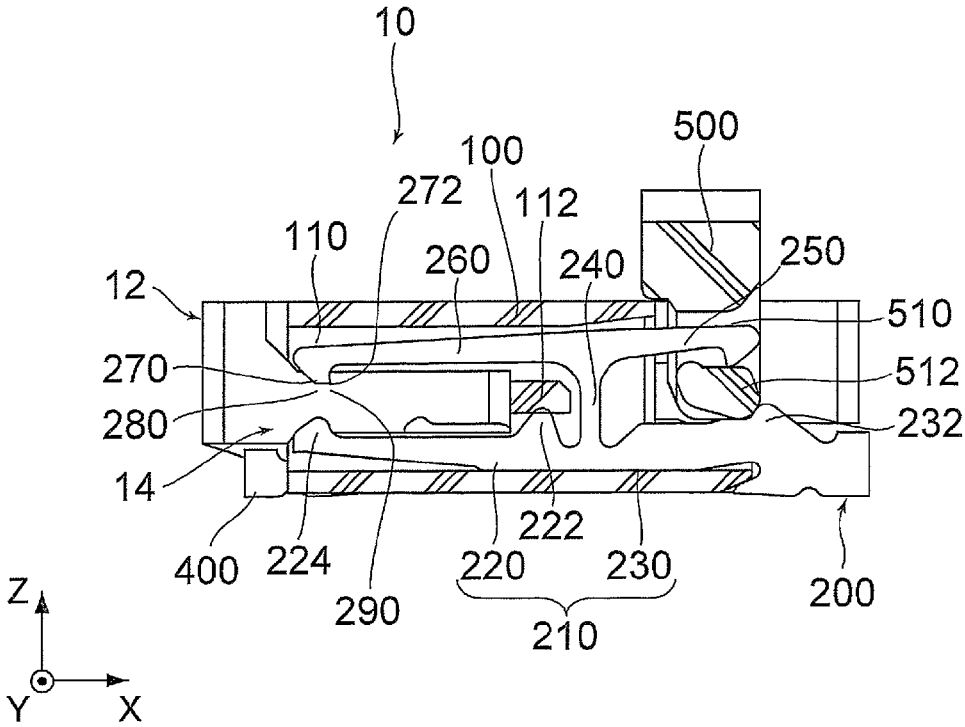
FIG. 4 is a cross-sectional view showing the connector of FIG. 1, taken along line IV-IV, wherein an actuator of the connector is in an open state.
Figure 7:
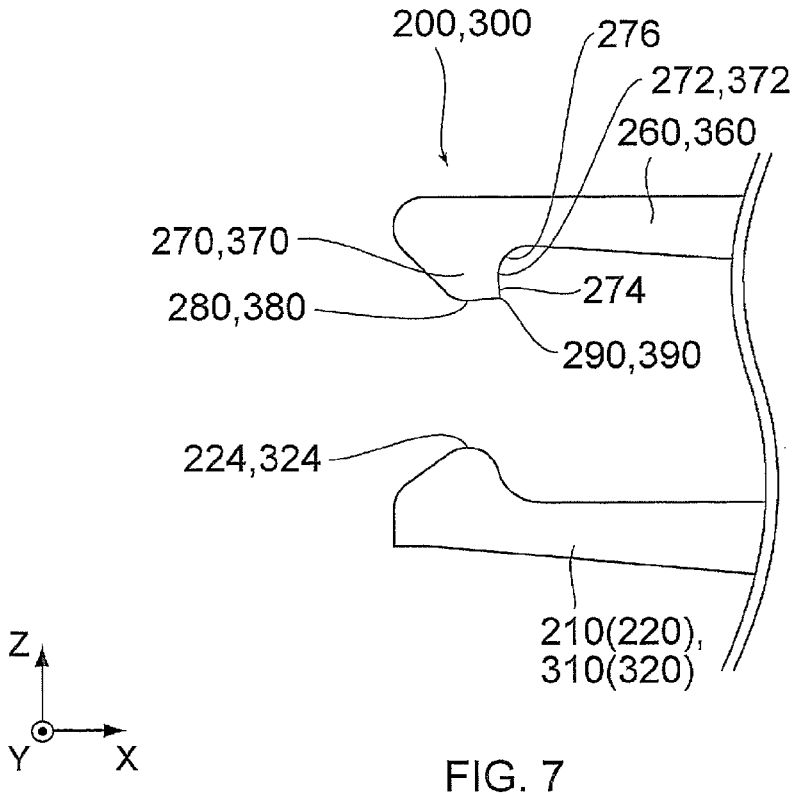
FIG. 7 is a side view showing an end portion which is formed on each of a holding member of FIG. 4 and a first signal contact (signal contact) of FIG. 5.

As shown in FIGS. 4 and 7, the holding member 200 has a base portion 210, a stand portion 240, a pushed portion 250, a support portion 260 and a protruding portion 270. The base portion 210 consists of a front base-portion 220 and a rear base-portion 230. The stand portion 240 extends in the Z-direction (vertical direction) from the base portion 210. In detail, the stand portion 240 extends in the positive Z-direction (i.e. upward) from a boundary portion between the front base-portion 220 and the rear base-portion 230. The pushed portion 250 extends in the positive X-direction (i.e. rearward) from an upper end of the stand portion 240. The support portion 260 extends in the negative X-direction (i.e. forward) from the upper end of the stand portion 240. The protruding portion 270 protrudes from the support portion 260 along the Z-direction. In detail, the protruding portion 270 protrudes in the negative Z-direction (i.e. downward) from the negative X-side end (i.e. front end) of the support portion 260. The front base-portion 220 and the support portion 260 are provided so as to face each other in the Z-direction. The rear base-portion 230 and the pushed portion 250 are provided so as to face each other in the Z-direction. The front base-portion 220 is provided with a press-fit portion 222. The press-fit portion 222 is press-fitted into the first press-fitted portion 112 when the holding member 200 is held by the first holding portion 110. The front base-portion 220 is formed with a facing contact-portion 224 at the negative X-side end (i.e. front end) thereof. The facing contact-portion 224 protrudes in the positive Z-direction (i.e. upward). The rear base-portion 230 is formed with a retaining protrusion 232 for preventing the actuator 500 from coming off as described later. The retaining protrusion 232 rises in the positive Z-direction (i.e. upward) from the rear base-portion 230. The stand portion 240, the pushed portion 250 and the support portion 260 correspond to a fulcrum, a power point and a working point, respectively. More specifically, the protruding portion 270 moves around the stand portion 240, which serves as the fulcrum, when the pushed portion 250 is pushed. Thus, the protruding portion 270 is supported by the support portion 260 so as to be movable in the Z-direction.

As best shown in FIG. 7, the protruding portion 270 is formed with a contact portion 280 and a lock portion 290. The contact portion 280 has a non-angular shape which extends linearly or curves gently. The lock portion 290 has an angular shape. The lock portion 290 is located at the positive X-side (i.e. rearward) of the contact portion 280 in the X-direction. The facing contact-portion 224 faces the contact portion 280 in the Z-direction. The protruding portion 270 has a rear edge 272 which extends from the lock portion 290 toward the support portion 260. The rear edge 272 according to the present embodiment has an end portion 274, which is located in the vicinity of the lock portion 290, and an end portion 276, which is located in the vicinity of the support portion 260. The end portion 274 extends linearly in the XZ-plane. The end portion 276 extends to draw a curve or an arc in the XZ-plane. The rear edge 272 may be formed to have only a part which extends to draw a curve or an arc. In other words, the rear edge 272 may not have a linear part. On the other hand, the rear edge 272 may be formed so as to have only a linear part.

Figure 5:
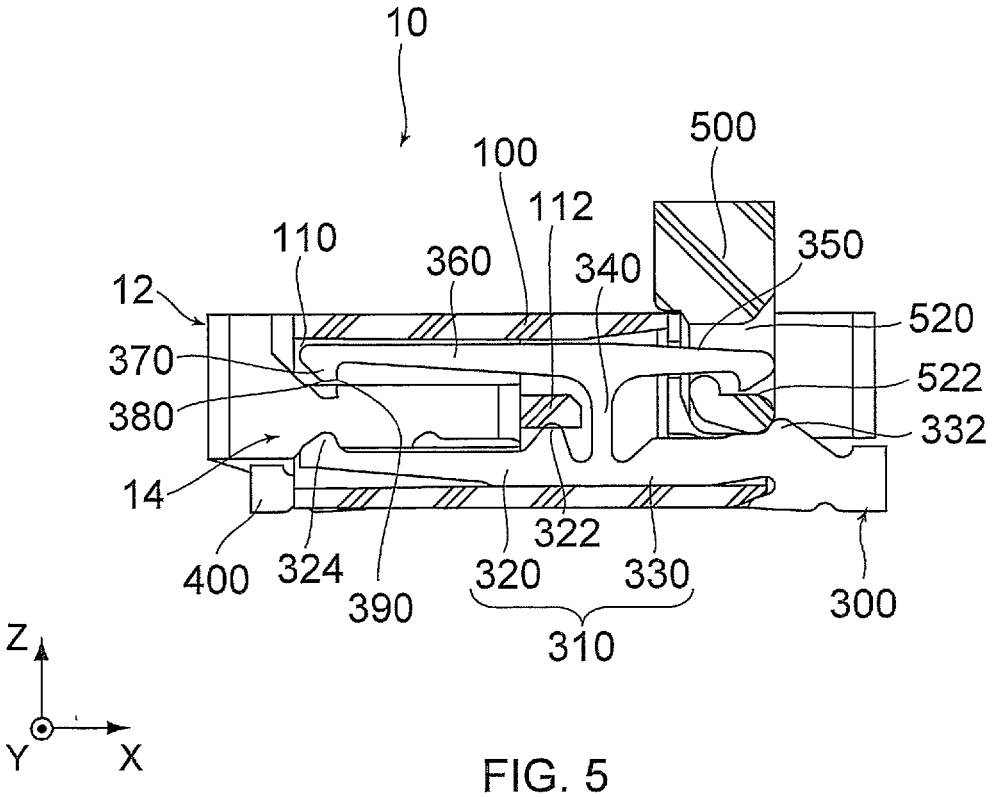
FIG. 5 is a cross-sectional view showing the connector of FIG. 1, taken along line V-V, wherein the actuator is in the open state.

As shown in FIGS. 5 and 7, the first signal contact 300 has a base portion 310, a stand portion 340, a pushed portion 350, a support portion 360 and a protruding portion 370. The base portion 310 consists of a front base-portion 320 and a rear base-portion 330. The stand portion 340 extends in the Z-direction (vertical direction) from the base portion 310. In detail, the stand portion 340 extends in the positive Z-direction (i.e. upward) from a boundary portion between the front base-portion 320 and the rear base-portion 330. The pushed portion 350 extends in the positive X-direction (i.e. rearward) from an upper end of the stand portion 340. The support portion 360 extends in the negative X-direction (i.e. forward) from the upper end of the stand portion 340. The protruding portion 370 protrudes from the support portion 360 along the Z-direction. In detail, the protruding portion 370 protrudes in the negative Z-direction (i.e. downward) from the negative X-side end (i.e. front end) of the support portion 360. The front base-portion 320 and the support portion 360 are provided so as to face each other in the Z-direction. The rear base-portion 330 and the pushed portion 350 are provided so as to face each other in the Z-direction. The front base-portion 320 is provided with a press-fit portion 322. The press-fit portion 322 is press-fitted into the first press-fitted portion 112 when the first signal contact 300 is held by the first holding portion 110. The front base-portion 320 is formed with a facing contact-portion 324 at the negative X-side end (i.e. front end) thereof. The facing contact-portion 324 protrudes in the positive Z-direction (i.e. upward). The rear base-portion 330 is formed with a retaining protrusion 332. The stand portion 340, the pushed portion 350 and the support portion 360 correspond to a fulcrum, a power point and a working point, respectively. More specifically, the protruding portion 370 moves around the stand portion 340, which serves as the fulcrum, when the pushed portion 350 is pushed. Thus, the protruding portion 370 is supported by the support portion 360 so as to be movable in the Z-direction.

As best shown in FIG. 7, the protruding portion 370 is formed with a contact portion 380 having a non-angular shape and a lock portion 390 having an angular shape. The lock portion 390 is located at the positive X-side (i.e. rearward) of the contact portion 380 in the X-direction. The facing contact-portion 324 faces the contact portion 380 in the Z-direction. The protruding portion 370 has a rear edge 372 which extends from the lock portion 390 toward the support portion 360.

As can be seen from FIGS. 4, 5 and 7, the first signal contact 300 and the holding member 200 has the same shape as each other. In other words, according to the present embodiment, the first signal contact 300 and the holding member 200 are the same component as each other. As can be seen from FIGS. 2, 4 and 5, the two holding members 200 and the many first signal contacts 300 are press-fitted into the first holding portions 110 from the positive X-side of (i.e. behind) the housing 100 along the negative X-direction (i.e. forward) to be held by the housing 100. All of the first signal contacts 300 held by the housing 100 are located between the two holding members 200 held by the housing 100 in the Y-direction.

Figure 6:
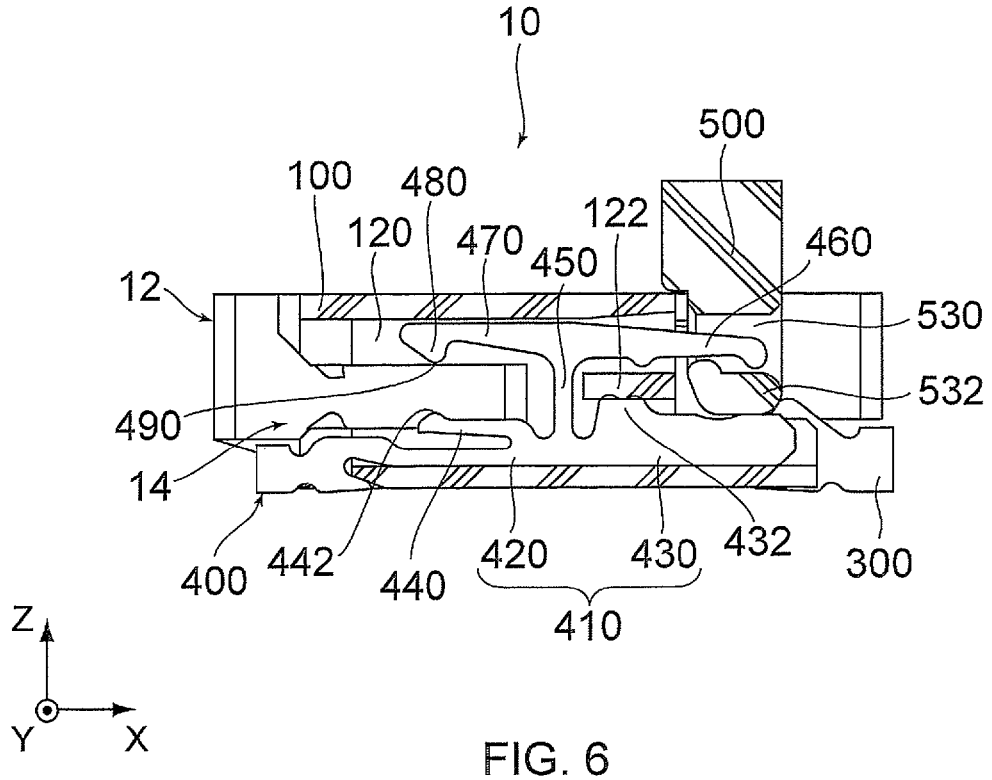
FIG. 6 is a cross-sectional view showing the connector of FIG. 1, taken along line VI-VI, wherein the actuator is in the open state.

As shown in FIG. 6, the second signal contact 400 has a base portion 410, a facing support-portion 440, a stand portion 450, a pushed portion 460, a support portion 470 and a protruding portion 480. The base portion 410 consists of a front base-portion 420 and a rear base-portion 430. The facing support-portion 440 extends in the negative X-direction from the front base-portion 420. The stand portion 450 extends in the Z-direction (vertical direction) from the base portion 410. In detail, the stand portion 450 extends in the positive Z-direction (i.e. upward) from a boundary portion between the front base-portion 420 and the rear base-portion 430. The pushed portion 460 extends in the positive X-direction (i.e. rearward) from an upper end of the stand portion 450. The support portion 470 extends in the negative X-direction (i.e. forward) from the upper end of the stand portion 450. The protruding portion 480 protrudes from the support portion 470 along the Z-direction. In detail, the protruding portion 480 protrudes in the negative Z-direction (i.e. downward) from the negative X-side end (i.e. front end) of the support portion 470. Each of the front base-portion 420 and the facing support-portion 440 is provided so as to face the support portion 470 in the Z-direction. The rear base-portion 430 and the pushed portion 460 are provided so as to face each other in the Z-direction. The rear base-portion 430 is provided with a press-fit portion 432. The press-fit portion 432 is press-fitted into the second press-fitted portion 122 when the second signal contact 400 is held by the second holding portion 120. The facing support-portion 440 extends from a part of the front base-portion 420, wherein the part of the front base-portion 420 is located in the vicinity of the stand portion 450. The facing support-portion 440 is formed with a facing contact-portion 442 at the negative X-side end (i.e. front end) thereof. The facing contact-portion 442 protrudes in the positive Z-direction (i.e. upward). The stand portion 450, the pushed portion 460 and the support portion 470 correspond to a fulcrum, a power point and a working point, respectively. More specifically, the protruding portion 480 moves around the stand portion 450, which serves as the fulcrum, when the pushed portion 460 is pushed. Thus, the protruding portion 480 is supported by the support portion 470 so as to be movable in the Z-direction.

As can be seen from FIG. 6, the protruding portion 480 of the second signal contact 400 is formed with a contact portion 490 having a non-angular shape while formed with no lock portion having an angular shape. The facing contact-portion 442 faces the contact portion 490 in the Z-direction. The second signal contacts 400 according to the present embodiment are press-fitted into the second holding portions 120 from the negative X-side of (i.e. in front of) the housing 100 along the positive X-direction (i.e. rearward) to be held by the housing 100.

As can be seen from FIGS. 1 and 2, the holding members 200 and the first signal contacts 300 constitute a group of a plurality of members, wherein the members of this group and the second signal contacts 400 are held by the housing 100 so as to be arranged alternately in the Y-direction. In detail, the two holding members 200 are located at respective outermost positions in the Y-direction of a row of the holding members 200, the first signal contacts 300 and the second signal contacts 400. One of the second signal contacts 400 is located next to one of the holding members 200. Then, one of the first signal contacts 300 is located next to the second signal contact 400. The second signal contact 400 and the first signal contact 300 are arranged in cyclic order.

As can be seen from FIGS. 1 to 3, the actuator 500 according to the present embodiment has a plate-like shape. The actuator 500 is supported by the housing 100 so as to be pivotable between an open state (see FIG. 1) and a close state (see FIG. 3). Especially, the actuator 500 according to the present embodiment is configured to transfer to the close state when turned to be away from the front end 12. In other words, the connector 10 according to the present embodiment is a so-called back-flip connector.

As can be seen from FIGS. 2 and 4 to 6, the actuator 500 is formed with a plurality of accommodating slits 510, 520 and 530, two retaining cams 512, a plurality of first contact cams (contact cams) 522 and a plurality of second contact cams 532. Each of the accommodating slits 510, 520 and 530 pierces the actuator 500 in a thickness direction. The pushed portion 250 of the holding member 200, the pushed portion 350 of the first signal contact 300 and the pushed portion 460 of the second signal contact 400 are accommodated in the accommodating slits 510, 520 and 530, respectively, so as to be movable.

Figure 8:
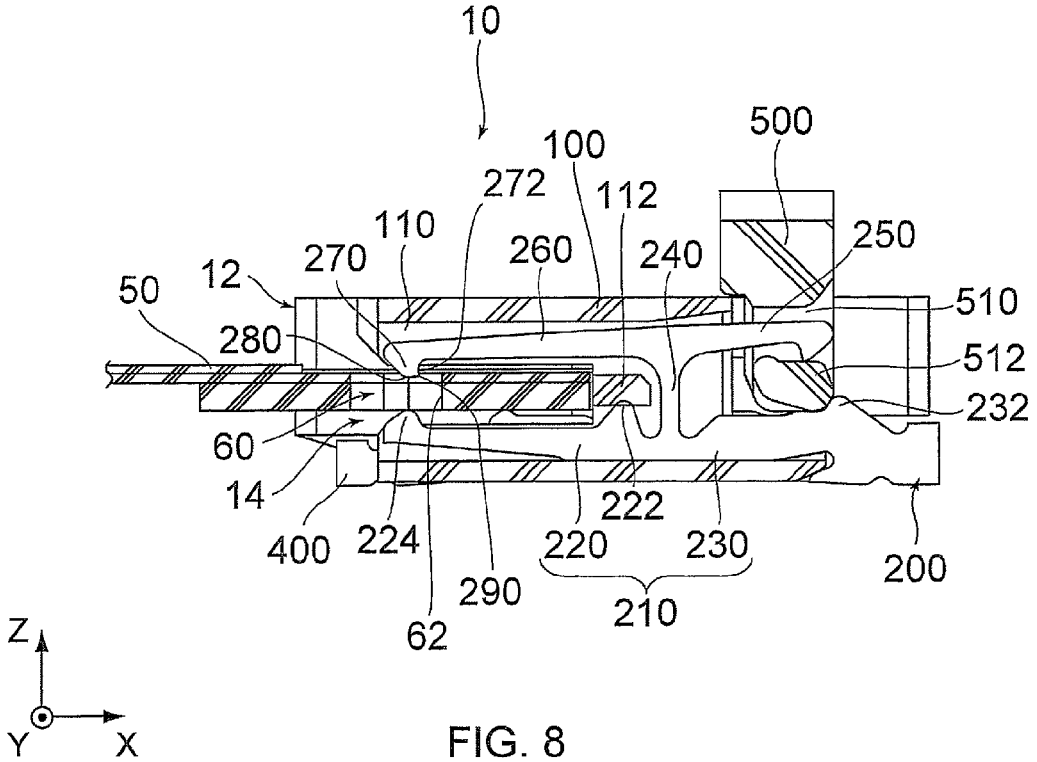
FIG. 8 is another cross-sectional view showing the connector of FIG. 4, wherein the FPC is inserted in the connector, and the actuator is in the open state.
Figure 11:
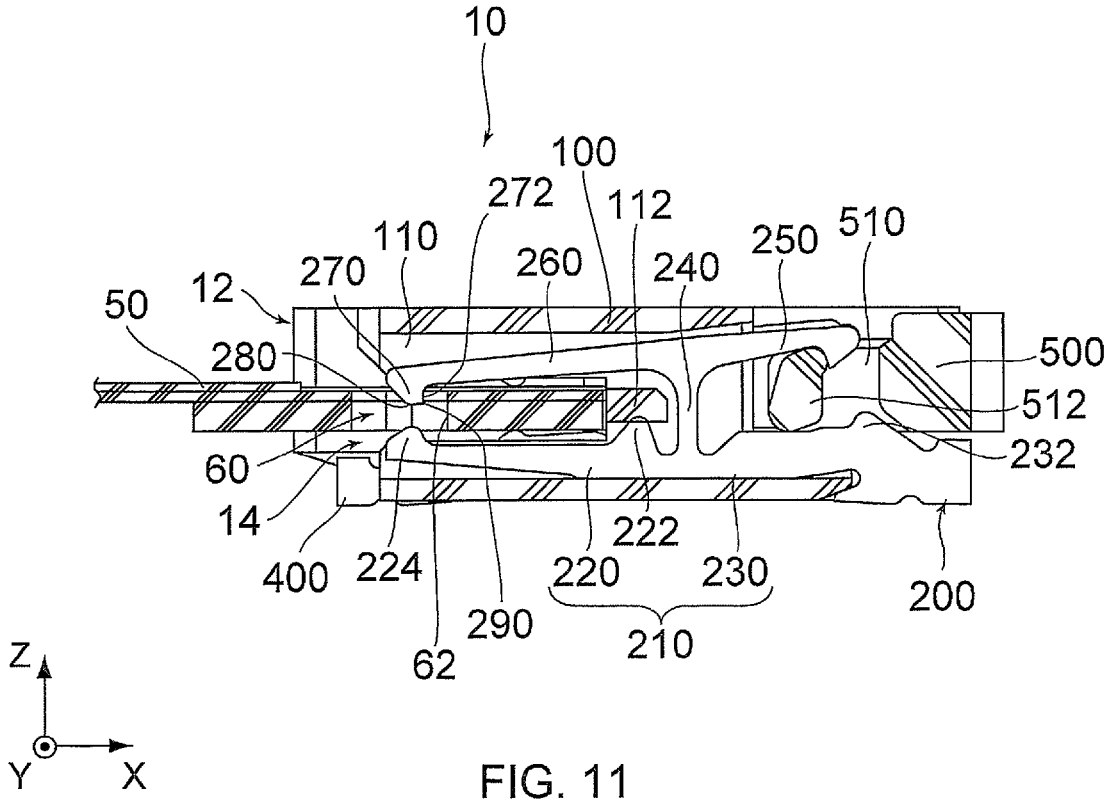
FIG. 11 is still another cross-sectional view showing the connector of FIG. 4, wherein the FPC is inserted in the connector, and the actuator is in a close state.

As shown in FIGS. 4, 8 and 11, the retaining cam 512 is in contact with the pushed portion 250 of the holding member 200 both when the actuator 500 is in the open state (see FIGS. 4 and 8) and when the actuator 500 is in the close state (see FIG. 11). Accordingly, the pushed portion 250 is pushed by the retaining cam 512 to receive a force along the positive Z-direction both when the actuator 500 is in the open state and when the actuator 500 is in the close state. In other words, the retaining cam 512 is constantly sandwiched by the pushed portion 250 and the rear base-portion 230 (i.e. base portion 210) so that the pushed portion 250 receives a force from the retaining cam 512. In addition, the retaining protrusion 232, which is provided on the rear base-portion 230 of the holding member 200, is located at the positive X-side of (i.e. behind) the retaining cam 512. As described above, the retaining protrusion 232 is located behind of the retaining cam 512 which is constantly sandwiched by the pushed portion 250 and the rear base-portion 230 (i.e. base portion 210). Accordingly, the actuator 500 does not easily come off the connector 10 not only when the actuator 500 is in the close state but also when the actuator 500 is in the open state.

As can be seen by comparing FIG. 4 with FIG. 11, a force which is applied to the pushed portion 250 by the retaining cam 512 under the open state of the actuator 500 is different from another force which is applied to the pushed portion 250 by the retaining cam 512 under the close state of the actuator 500. More specifically, the retaining cam 512 under the close state of the actuator 500 applies a larger force to the pushed portion 250 as compared with the retaining cam 512 under the open state of the actuator 500. Accordingly, the protruding portion 270 under the close state of the actuator 500 receives a larger force toward the negative Z-side (i.e. a larger downward force) as compared with the protruding portion 270 under the open state of the actuator 500.

As can be seen from FIG. 8, if the actuator 500 is detached from the connector 10, the protruding portion 270 of the holding member 200 is located at an initial position (not shown). Even when the actuator 500 is in the open state, the protruding portion 270 is moved along the negative Z-direction (i.e. downward) from the initial position. Thus, a distance between the contact portion 280 and the facing contact-portion 224 under the open state of the actuator 500 is smaller than another distance between the contact portion 280 and the facing contact-portion 224 under a state where the protruding portion 270 is located at the initial position. Accordingly, as shown in FIG. 8, when the FPC 50 is received in the receive portion 14 under the open state of the actuator 500, the lock portion 290 is inserted into the recess 60 to be located at the negative X-side of (i.e. in front of) the locked portion 62. According to the present embodiment, when the FPC 50 is received in the receive portion 14 under the open state of the actuator 500, the lock portion 290 faces the locked portion 62 in the X-direction. Accordingly, a movement of the FPC 50 in the negative X-direction is regulated so that the FPC 50 is temporarily held by the connector 10. In the meantime, the lock portion 290 is located at a temporary holding position. The retaining cam 512 applies a force to the holding member 200 so as to locate the lock portion 290 at the temporary holding position. When the lock portion 290 of the holding member 200 is located at the temporary holding position, a part of the rear edge 272 of the protruding portion 270 of the holding member 200 is located, in the Z-direction, at the same position as a part of the locked portion 62 of the FPC 50 while located, in the X-direction, in front of the part of the locked portion 62. In other words, the locked portion 62 and the rear edge 272 overlap each other in the Z-direction.

As shown in FIG. 11, when the actuator 500 is in the close state, the protruding portion 270 is further moved in the negative Z-direction. In the meantime, the lock portion 290 is located at a regulation position. The retaining cam 512 applies a larger force to the holding member 200 so as to locate the lock portion 290 at the regulation position. As can be seen from the above description, when the lock portion 290 of the holding member 200 is located at the regulation position, the protruding portion 270 of the holding member 200 is located at a first position. When the lock portion 290 of the holding member 200 is located at the temporary holding position, the protruding portion 270 of the holding member 200 is located at a second position which is different from the first position. A movement of the protruding portion 270 of the holding member 200 from the initial position to the first position is larger than a movement of the protruding portion 270 of the holding member 200 from the initial position to the second position. Moreover, a distance between the contact portion 280 and the facing contact-portion 224 under the close state of the actuator 500 is further smaller than the distance between the contact portion 280 and the facing contact-portion 224 under the open state of the actuator 500. Accordingly, as shown in FIG. 11, when the actuator 500 is turned from the open state to the close state after the FPC 50 is received in the receive portion 14, the lock portion 290 is further inserted into the recess 60 to be located at the negative X-side of (i.e. in front of) the locked portion 62. Accordingly, a movement in the negative X-direction (i.e. forward movement) of the FPC 50 is more securely regulated by the lock portion 290 located at the regulation position as compared with the lock portion 290 located at the temporary holding position. When the lock portion 290 of the holding member 200 is located at the regulation position, the lock portion 290 is also located in front of the locked portion 62 of the FPC 50. In the meantime, the locked portion 62 and the rear edge 272 of the protruding portion 270 overlap each other in the Z-direction.

As can be seen from FIGS. 7 and 11, according to the present embodiment, when the lock portion 290 is located at the regulation position (i.e. when the actuator 500 is in the close state), the end portion 274 (see FIG. 7) located in the vicinity of the lock portion 290 of the rear edge 272 of the protruding portion 270 of the holding member 200 extends obliquely forward from the lock portion 290. Accordingly, the movement of the FPC 50 may be more securely regulated.

As previously described, a force applied to the pushed portion 250 under the open state of the actuator 500 is different from another force applied to the pushed portion 250 under the close state of the actuator 500. As a result, as can be seen by comparing FIG. 8 with FIG. 11, a catch (or catchable) amount under a state where the lock portion 290 of the holding member 200 is located at the temporary holding position is smaller than another catch (or catchable) amount under a state where the lock portion 290 of the holding member 200 is located at the regulation position, wherein the catch (or catchable) amount is an amount of a part of the protruding portion 270 of the holding member 200 which catches the locked portion 62 of the FPC 50 pulled in the negative X-direction. In detail, when the lock portion 290 of the holding member 200 is located at the temporary holding position, a first part of the rear edge 272 of the protruding portion 270 of the holding member 200 is located, in the Z-direction, at the same position as a part of the locked portion 62 of the FPC 50, wherein the first part has a first length in the Z-direction. When the lock portion 290 of the holding member 200 is located at the regulation position, a second part of the rear edge 272 of the protruding portion 270 of the holding member 200 is located, in the Z-direction, at the same position as a part of the locked portion 62 of the FPC 50, wherein the second part has a second length in the Z-direction. The first length is smaller than the second length. In other words, the inserted FPC 50 has a surface which faces the support portion 260 of the holding member 200 in the Z-direction. A distance between the lock portion 290 of the holding member 200 and the surface of the FPC 50 under a state where the lock portion 290 of the holding member 200 is located at the temporary holding position is smaller than another distance between the lock portion 290 of the holding member 200 and the surface of the FPC 50 under another state where the lock portion 290 of the holding member 200 is located at the regulation position.

Figure 9:
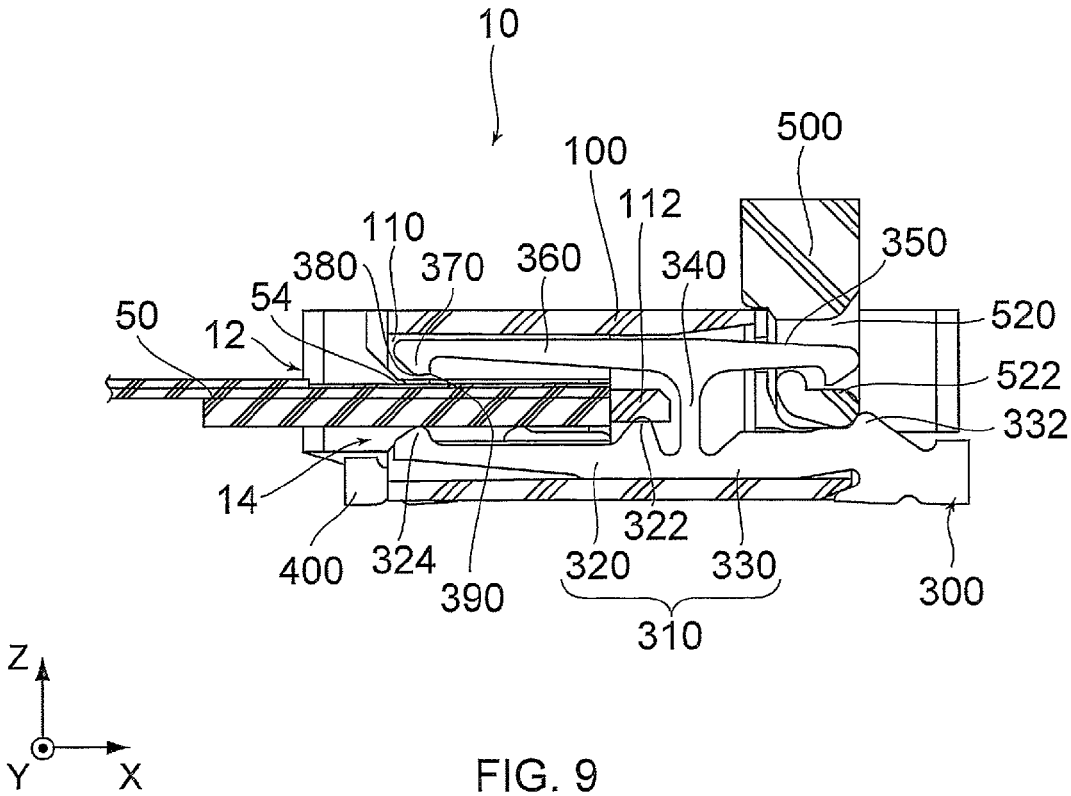
FIG. 9 is another cross-sectional view showing the connector of FIG. 5, wherein the FPC is inserted in the connector, and the actuator is in the open state.
Figure 12:
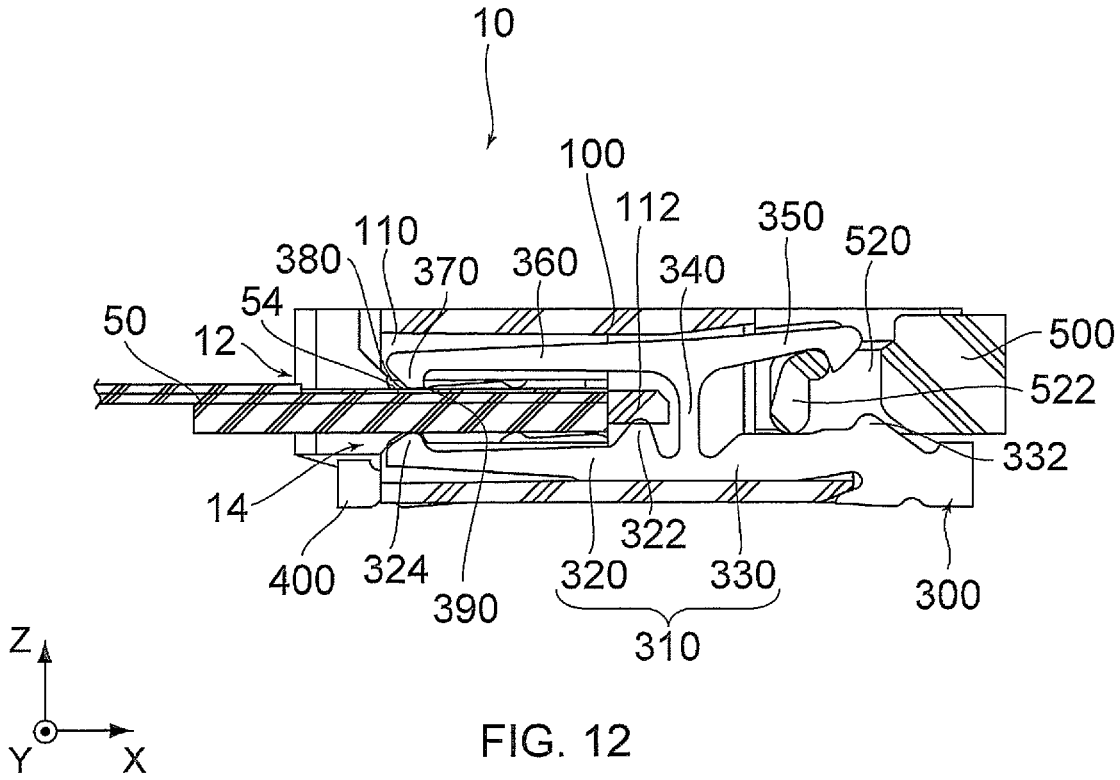
FIG. 12 is still another cross-sectional view showing the connector of FIG. 5, wherein the FPC is inserted in the connector, and the actuator is in the close state.

As can be seen by comparing FIGS. 5 and 9 with FIG. 12, the first contact cam 522 according to the present embodiment is not brought into contact with the pushed portion 350 of the first signal contact 300 under the open state of the actuator 500 (see FIGS. 5 and 9) while brought into contact with the pushed portion 350 of the first signal contact 300 under the close state of the actuator 500 (see FIG. 12). Accordingly, the pushed portion 350 according to the present embodiment is pushed by the first contact cam 522 to receive a force along the positive Z-direction only when the actuator 500 is in the close state. Thus, a force which is applied to the pushed portion 350 by the first contact cam 522 under the open state of the actuator 500 is different from another force which is applied to the pushed portion 350 by the first contact cam 522 under the close state of the actuator 500. Especially, the first contact cam 522 according to the present embodiment applies no force to the pushed portion 350 when the actuator 500 is in the open state. On the other hand, the first contact cam 522 applies a force to the pushed portion 350 when the actuator 500 is in the close state. Accordingly, the protruding portion 370 under the close state of the actuator 500 is located at the negative Z-side position (i.e. downward position) as compared with the protruding portion 370 under the open state of the actuator 500. Moreover, the first contact cam 522 is sandwiched by the pushed portion 350 and the rear base-portion 330 (i.e. the base portion 310) only when the actuator 500 is in the close state.

As shown in FIGS. 4 and 5, when the actuator 500 is in the open state, a distance between the contact portion 280 and the facing contact-portion 224 of the holding member 200 is smaller than another distance between the contact portion 380 and the facing contact-portion 324 of the first signal contact 300. Accordingly, although the holding member 200 and the first signal contact 300 according to the present embodiment have the same shape as each other, it is possible to temporarily hold the FPC 50 at a predetermined position in the connector 10 by the holding member 200 when the actuator 500 is in the open state.

As can be seen from FIG. 9, when the actuator 500 is in the open state, the protruding portion 370 is located above the FPC 50 which is received in the receive portion 14. As can be seen from FIG. 12, when the actuator 500 is in the close state, the contact portion 380 of the protruding portion 370 is pressed against the terminal 54 of the FPC 50 which is received in the receive portion 14. Thus, a distance between the contact portion 380 and the facing contact-portion 324 under the close state of the actuator 500 is smaller than another distance between the contact portion 380 and the facing contact-portion 324 under the open state of the actuator 500. When the actuator 500 is in the close sate and the contact portion 380 is pressed against the terminal 54, the lock portion 390 of the first signal contact 300 is not brought into contact with the FPC 50. In detail, the lock portion 390 is apart from the FPC 50 in the positive Z-direction (i.e. upward). Accordingly, the lock portion 390 does not damage the FPC 50.

Figure 10:
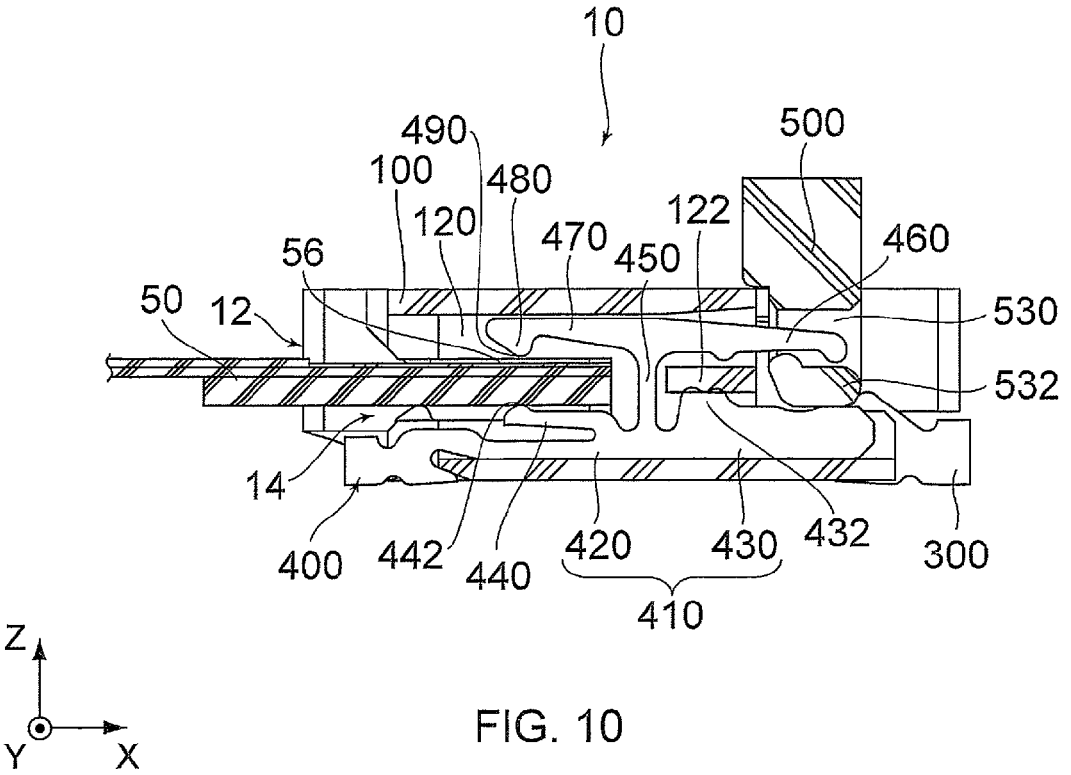
FIG. 10 is another cross-sectional view showing the connector of FIG. 6, wherein the FPC is inserted in the connector, and the actuator is in the open state.
Figure 13:
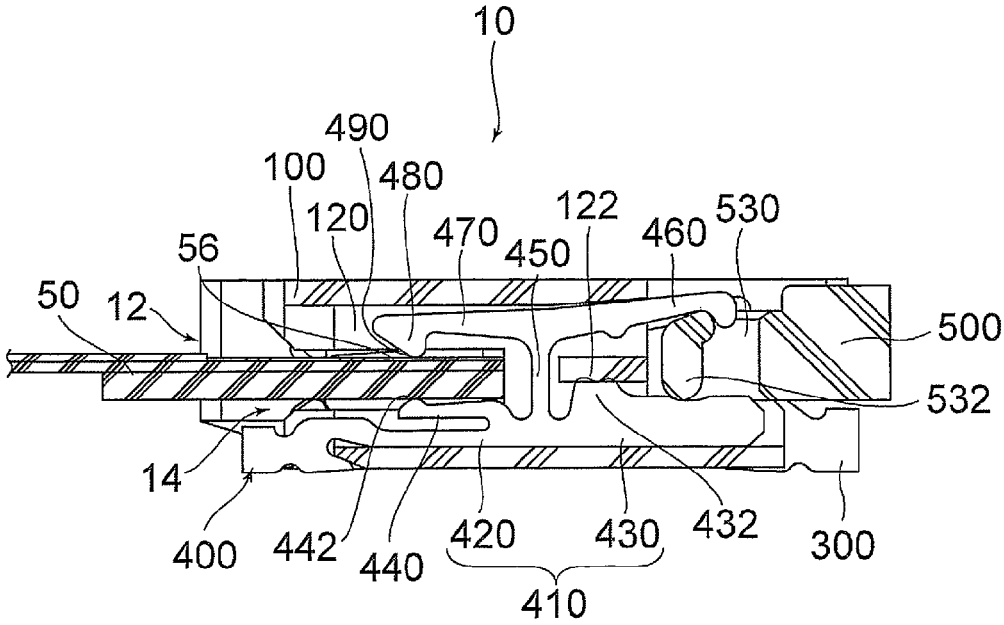
FIG. 13 is still another cross-sectional view showing the connector of FIG. 6, wherein the FPC is inserted in the connector, and the actuator is in the close state.
Figure 13:
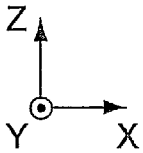
Figure 14:
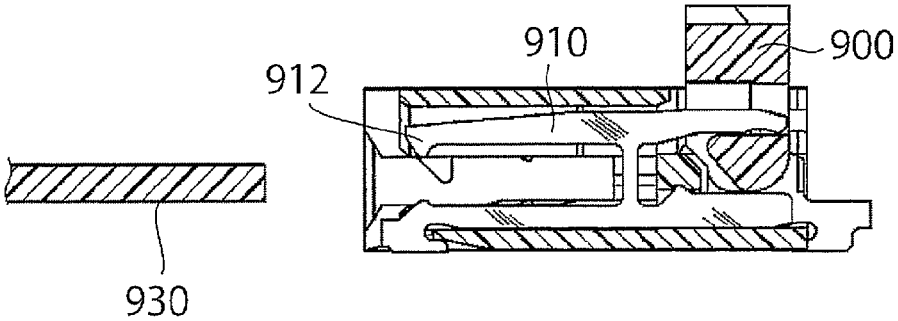
PRIOR ART FIG. 14
FIG. 14 is a cross-sectional view showing two different portions of an existing connector.
Figure 14:
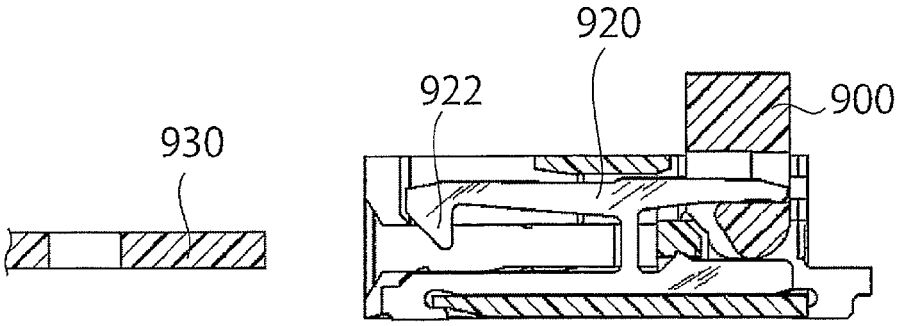
PRIOR ART FIG. 14
Figure 15:
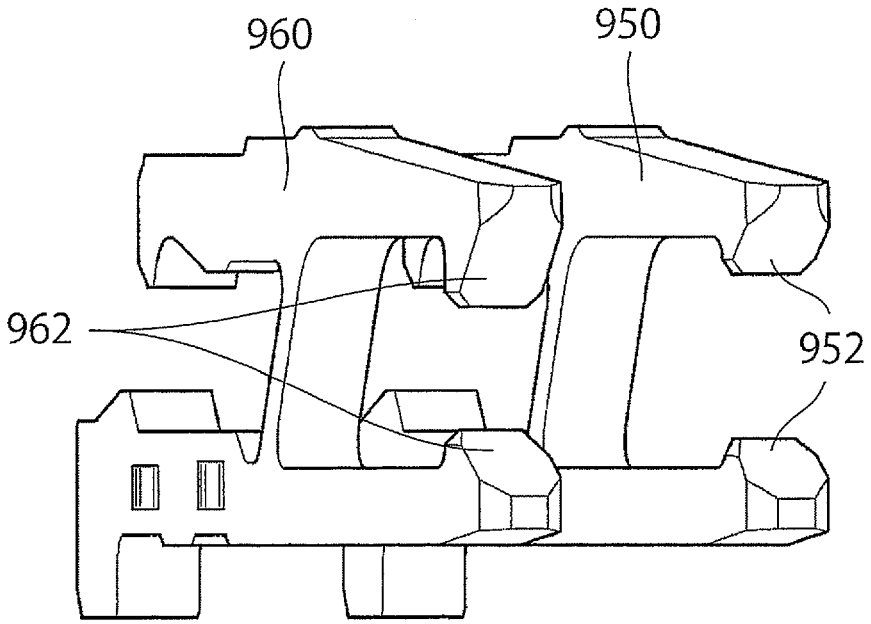
FIG. 15 is a perspective view showing a contact and a holding terminal of another existing connector.

As can be seen by comparing FIGS. 6 and 10 with FIG. 13, the second contact cam 532 according to the present embodiment is not brought into contact with the pushed portion 460 of the second signal contact 400 under the open state of the actuator 500 (see FIGS. 6 and 10) while brought into contact with the pushed portion 460 of the second signal contact 400 under the close state of the actuator 500 (see FIG. 13). Accordingly, the pushed portion 460 according to the present embodiment is pushed by the second contact cam 532 to receive a force along the positive Z-direction only when the actuator 500 is in the close state. Thus, a force which is applied to the pushed portion 460 by the second contact cam 532 under the open state of the actuator 500 is different from another force which is applied to the pushed portion 460 by the second contact cam 532 under the close state of the actuator 500. Especially, the second contact cam 532 according to the present embodiment applies no force to the pushed portion 460 when the actuator 500 is in the open state. On the other hand, the second contact cam 532 applies a force to the pushed portion 460 when the actuator 500 is in the close state. Accordingly, the protruding portion 480 under the close state of the actuator 500 is located at the negative Z-side position (i.e. downward position) as compared with the protruding portion 480 under the open state of the actuator 500. Moreover, the second contact cam 532 is sandwiched by the pushed portion 460 and the rear base-portion 430 (i.e. the base portion 410) only when the actuator 500 is in the close state.

As can be seen from FIG. 10, when the actuator 500 is in the open state, the protruding portion 480 is located above the FPC 50 which is received in the receive portion 14. As can be seen from FIG. 13, when the actuator 500 is in the close state, the contact portion 490 of the protruding portion 480 is pressed against the terminal 56 of the FPC 50 which is received in the receive portion 14. Thus, a distance between the contact portion 490 and the facing contact-portion 442 under the close state of the actuator 500 is smaller than another distance between the contact portion 490 and the facing contact-portion 442 under the open state of the actuator 500.

As can be seen from the aforementioned description, a distance between the contact portion 380 and the facing contact-portion 324 according to the present embodiment is larger than a thickness of the FPC 50. Moreover, a distance between the contact portion 490 and the facing contact-portion 442 according to the present embodiment is larger than the thickness of the FPC 50. Accordingly, during a process where the FPC 50 is received into the receive portion 14, the FPC 50 receives only forces which are applied by the two holding member 200. In other words, the receiving of the FPC 50 into the receive portion 14 does not become difficult due to the installation of the holding member 200.

As described above, the first signal contact 300 and the holding member 200 have the same shape as each other. In detail, the first signal contact 300 and the holding member 200 are provided with the contact portion 280 and the contact portion 380, respectively. The contact portion 280 and the contact portion 380 have the same shape suitable for a contact. Moreover, the first signal contact 300 and the holding member 200 are provided with the lock portion 290 and the lock portion 390, respectively. The lock portion 290 and the lock portion 390 have the same shape suitable for holding the FPC 50. Accordingly, the first signal contact 300 and the holding member 200 are formable from a common member. In other words, according to the present embodiment, it is possible to provide a function for holding the FPC 50 without increasing the number of types of components.

A connector according to the present invention is not limited to the aforementioned connector 10 according to the present embodiment.

For example, the protruding portion 270 may be pressed in the negative Z-direction by using a member other than the actuator 500. More specifically, a pressing portion may be formed by modifying, for example, the housing 100. In this case, when the actuator 500 is in the open state, a force may be applied to the holding member 200 by using the pressing portion so that the protruding portion 270 may be pressed in the negative Z-direction.

If the function for temporarily holding the FPC 50 is unnecessary, the holding member 200 may be configured, similar to the first signal contact 300, to receive no force when the actuator 500 is in the open state. Even in this case, the holding member 200 and the first signal contact 300 may be members having the same shape as each other. When the actuator 500 is in the close state, one of the members (i.e. the holding member 200) holds the FPC 50 while the other one of the members (i.e. the first signal contact 300) is brought into electrical contact with the FPC 50. Accordingly, it is possible to realize both the function for holding the FPC 50 and the function for an electrical contact without increasing the number of types of components.

According to the aforementioned embodiment, the first contact cam 522 is not brought into contact with the pushed portion 350 of the first signal contact 300 (i.e. applies no force to the pushed portion 350) when the actuator 500 is in the open state. The first contact cam 522 may apply a force to the pushed portion 350 of the first signal contact 300 even when the actuator 500 is in the open state. However, if the force is too large, the FPC 50 may not be received into the receive portion smoothly. Accordingly, similar to the present embodiment, it is preferred that the first contact cam 522 and the pushed portion 350 be arranged so as not to apply a force to each other under the open state of the actuator 500.

According to the aforementioned embodiment, the holding member 200 has the front base-portion 220 and the first signal contact 300 has the front base-portion 320. However, the holding member 200 and the first signal contact 300 may not have the front base-portion 220 and the front base-portion 320, respectively.

Although the connector 10 according to the aforementioned embodiment is a back-flip connector, the present invention is applicable to a front-flip connector.

The present application is based on a Japanese patent application of JP2012-131688 filed before the Japan Patent Office on Jun. 11, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector configured to allow a sheet-like or plate-like object to be inserted rearward from a front end in a front-rear direction, the object having a locked portion, the connector comprising:

a housing;

an actuator supported by the housing so as to be pivotable between an open state and a close state; and a plurality of members including a signal contact and a holding member, the signal contact and the holding member being held by the housing so as to be arranged in a pitch direction perpendicular to the front-rear direction, the signal contact having a shape same as the holding member, each of the signal contact and the holding member having a contact portion and a lock portion located rearward of the contact portion in the front-rear direction, each of the contact portions having a non-angular shape, each of the lock portions having an angular shape, the contact portion of the signal contact being pressed against the object under a predetermined state where the object is inserted in the connector and where the actuator is in the close state, the lock portion of the signal contact being apart from the object in a vertical direction perpendicular to both the front-rear direction and the pitch direction under the predetermined state, the lock portion of the holding member being located at a regulation position under the predetermined state, the regulation position being in front of the locked portion of the object, the lock portion of the holding member regulating a forward movement of the object when located at the regulation position.

2. The connector as recited in claim 1, wherein:

each of the signal contact and the holding member has a support portion and a protruding portion, the protruding portions protruding from the support portions along the vertical direction, respectively, the protruding portions being supported by the support portions so as to be movable in the vertical direction, respectively; and each of the protruding portions is formed with the contact portion and the lock portion.

3. The connector as recited in claim 2, wherein:

each of the protruding portions has a rear edge which extends from the lock portion toward the support portion, the rear edge having an end portion which is located in the vicinity of the lock portion; and the end portion of the rear edge extends obliquely forward from the lock portion when the actuator is in the close state.

4. The connector as recited in claim 3, wherein:

when the object is inserted and the actuator is in the open state, the lock portion of the holding member is located at a temporary holding position in front of the locked portion of the object;

when the lock portion of the holding member is located at the temporary holding position, a part of the protruding portion of the holding member is located, in the vertical direction, at a position same as a part of the locked portion of the object;

if the actuator is detached from the connector, the protruding portion of the holding member is located at an initial position;

when the lock portion of the holding member is located at the regulation position, the protruding portion of the holding member is located at a first position;

when the lock portion of the holding member is located at the temporary holding position, the protruding portion of the holding member is located at a second position; and a movement of the protruding portion of the holding member from the initial position to the first position is larger than a movement of the protruding portion of the holding member from the initial position to the second position.

5. The connector as recited in claim 4, wherein:

when the lock portion of the holding member is located at the temporary holding position, a first part of the rear edge of the protruding portion of the holding member is located, in the vertical direction, at a position same as a part of the locked portion of the object, the first part having a first length in the vertical direction;

when the lock portion of the holding member is located at the regulation position, a second part of the rear edge of the protruding portion of the holding member is located, in the vertical direction, at another position same as another part of the locked portion of the object, the second part having a second length in the vertical direction; and the first length is smaller than the second length.

6. The connector as recited in claim 3, wherein:

when the object is inserted and the actuator is in the open state, the lock portion of the holding member is located at a temporary holding position in front of the locked portion of the object;

when the lock portion of the holding member is located at the temporary holding position, a part of the protruding portion of the holding member is located, in the vertical direction, at a position same as a part of the locked portion of the object;

the inserted object has a surface which faces the support portion of the holding member in the vertical direction; and a distance between the lock portion of the holding member and the surface of the object under a state where the lock portion of the holding member is located at the temporary holding position is smaller than another distance between the lock portion of the holding member and the surface of the object under another state where the lock portion of the holding member is located at the regulation position.

7. The connector as recited in claim 4, wherein:

each of the signal contact and the holding member further has a facing contact-portion, the facing contact-portions facing the contact portions in the vertical direction, respectively; and when the actuator is in the open state, a distance between the contact portion and the facing contact-portion of the holding member is smaller than another distance between the contact portion and the facing contact-portion of the signal contact.

8. The connector as recited in claim 4, wherein:

the actuator is provided with a retaining cam and a contact cam, the retaining cam being configured to apply a force to the holding member, the contact cam being configured to apply a force to the signal contact;

when the object is inserted and the actuator is in the open state, the retaining cam applies a force to the holding member so as to locate the lock portion of the holding member at the temporary holding position;

when the object is inserted and the actuator is in the close state, the retaining cam applies a larger force to the holding member so as to locate the lock portion of the holding member at the regulation position;

when the object is inserted and the actuator is in the open state, the contact cam applies no force to the signal contact; and when the object is inserted and the actuator is in the close state, the contact cam presses the contact portion of the signal contact against the object.

9. The connector as recited in claim 8, wherein:

each of the signal contact and the holding member further has a base portion, a stand portion and a pushed portion, stand portions extending in the vertical direction from the base portions, respectively, the pushed portions extending rearward in the front-rear direction from the stand portions, respectively;

the support portion extends forward from the stand portion;

the pushed portion faces the base portion in the vertical direction; and the pushed portion receives a force from the retaining cam or the contact cam when the pushed portion and the base portion sandwich the retaining cam or the contact cam of the actuator.

10. The connector as recited in claim 9, wherein:

each of the base portions is formed with a retaining protrusion, the retaining protrusions protruding in the vertical direction toward the pushed portions, respectively; and the retaining protrusion of the holding member is located behind the retaining cam in the front-rear direction.

* * * * *